United States Patent [19]

Mitsuyoshi et al.

[11] Patent Number: 4,467,505

[45] Date of Patent: Aug. 28, 1984

[54] RAISING MACHINE FOR PRODUCING SUEDE TONE FINISH WITH DIAMOND-SHAPE CROSS-SECTION WIRES ON THE COUNTER PILE ROLLERS

[75] Inventors: Toru Mitsuyoshi, Amagasaki; Yasuyuki Uchida, Kobe, both of Japan

[73] Assignee: Hiroyuki Kanai, Ashiya, Japan

[21] Appl. No.: 387,266

[22] Filed: Jun. 9, 1982

Related U.S. Application Data

[63] Continuation of Ser. No. 082,591, Oct. 19, 1979, abandoned.

[30] Foreign Application Priority Data

Oct. 13, 1978 [JP] Japan ..... 53-141349[U]

[51] Int. Cl.[3] ..... D06C 11/00

[52] U.S. Cl. ..... 26/33

[58] Field of Search ..... 19/114; 26/31, 32, 33, 26/34

[56] References Cited

U.S. PATENT DOCUMENTS

| | | | |
|---|---|---|---|
| 359,928 | 3/1887 | Kenyon | 19/114 UX |
| 401,991 | 4/1889 | Ashworth et al. | 19/114 |
| 2,937,412 | 5/1960 | Hollingsworth | 19/114 |
| 3,175,224 | 3/1965 | Bertrand | 26/33 |

FOREIGN PATENT DOCUMENTS

| | | | |
|---|---|---|---|
| 560518 | 4/1960 | Belgium | 19/114 |
| 3283 | of 1872 | United Kingdom | 19/114 |
| 23470 | of 1914 | United Kingdom | 26/31 |
| 974186 | 11/1964 | United Kingdom | 19/114 |

OTHER PUBLICATIONS

Timmerman, John F. *Woolen and Worsted Finishing*, Chicago, American School of Correspondence, 1908, pp. 82–84.

Schofield, John *Cloth Finishing: Woolen & Worsted*, N.Y., Bragdon, Lord & Nagle Co., 1927, Chapter XV, pp. 551–553, 573–575.

*Primary Examiner*—Robert Mackey

*Attorney, Agent, or Firm*—Wenderoth, Lind & Ponack

[57] ABSTRACT

Raising machine wire clothing with wires of substantially diamond-shape in cross section set thereon and a raising machine using such raising machine wire clothing. This raising machine wire clothing is suitable for raising-finish of short piles and high density of nap, namely, so-called suede tone finish.

3 Claims, 17 Drawing Figures

RAISING MACHINE FOR PRODUCING SUEDE TONE FINISH WITH DIAMOND-SHAPE CROSS-SECTION WIRES ON THE COUNTER PILE ROLLERS

This application is a continuation of application Ser. No. 082,591, filed Oct. 19, 1979, now abandoned.

This invention relates to a raising machine having wire clothing which is effective for enhancing the value of textile goods.

BACKGROUND OF THE INVENTION AND PRIOR ART

Reflecting the trend in the field of textile goods in recent years, growing attention has been paid to the raising finish of textile goods, especially a raising machine with wire clothing suitable for the cut-raising finish of short pile and dense nap or a so-called suede tone finish.

In the conventional raising machine shown in FIG. 1, a wire clothing 3 such as shown in FIG. 2 and FIG. 3 is used and is wound around counter pile rollers 1 and pile rollers 2.

The conventional raising machine wire clothing is made by setting wires, which have an apex pointing in the working direction and which are substantially triangular, circular or elliptical in cross section, on a foundation cloth 5 with a rubber sheet at the surface thereof and their points are ground into needle-point shape. Since such wires have a large circular arc $r_1$ or $r_2$ in the cross section of the point directed in the working direction, they have disadvantages in that it is difficult to cut and raise drawn out loop piles, and also their useful life is short.

OBJECT OF THE INVENTION

The present invention has been made to eliminate the above-mentioned disadvantages of the conventional raising machine wire clothing and to provide novel wire clothing which is suitable for forming cut piles during the raising process and for a raising machine using such wire clothing.

BRIEF DESCRIPTION OF THE DRAWINGS

The nature and advantages of the present invention will be understood more clearly from the following description made with reference to preferred embodiments and accompanying drawings, in which:

FIG. 2(*b*) and FIG. 3(*b*) are respectively cross sections on an enlarged scale, of the wires of FIGS. 2(*a*) and 3(*a*);

FIG. 4(*b*) is a cross section, on an enlarged scale, of the wire shown in FIG. 4(*a*);

FIG. 7(*b*) and FIG. 8(*b*) are respectively a cross section, on an enlarged scale, of the wires shown in FIG. 7(*a*) and FIG. 8(*a*);

FIG. 9(*b*) and FIG. 10(*b*) are respectively a cross-section, on an enlarged scale, of the raising machine wire clothing shown in FIG. 9(*a*) and FIG. 10(*a*).

DETAILED DESCRIPTION OF THE INVENTION

Embodiment No. 1

An embodiment of the present invention is illustrated in FIGS. 4*a* and 4*b*, and 8*a* and 8*b*.

| Specifications of raising machine wire clothing: Raising machine wire clothing for the pile rollers: | |
|---|---|
| Height of the wire clothing (A): | 9–10 mm |
| Angle of working (X): | 40–50° |
| Angle of setting (Y) | 75–80° |
| Cross sectional shape of wire: | Substantially diamond (rhombic)-shape |
| Diameter of wire (D'/D): | 0.35/0.24–0.44/0.31 mm |
| Radius of curvature at wire point (R) in working direction: | 0.01–0.01 mm |
| Number of wire points: | 150–500 points/square inch |

According to the present invention, raising machine wire clothing is made in the following way.

Wires of substantially diamond (rhombic)-shape in cross section with one of the acute angle corners (R) facing in the working direction having a radius of curvature of from 0.01 to 0.1/mm, preferably about 0.2 mm, and the four sides flat, are set on a foundation cloth 5 comprising several layers of cotton cloth, hemp cloth or synthetic fiber cloth and a rubber surface layer bonded together and then their points are ground into a needle-point shape with a glassy, smooth surface. The wire clothing is then placed on the pile roller 2.

It is desirable that the radius of curvature at the acute angle corner of the wire point is less than 0.1 mm. If it is more than 0.1 mm, the effect of the cut-raising process will decrease. The sides of the wire can be either flat or concave, as long as the cross section is substantially diamond (rhombic)-shaped.

Preferably, the density of the wire points on the cloth 5 is within the range of 150–500 points per square inch. If it is less than 150 points per square inch, the density of the nap formed in each raising process will decrease. On the contrary, if it exceeds 500 points per square inch, the depth of piercing into cloth necessary for raising becomes very small, resulting in a sharp decrease of napping. The rubber surface layer of the foundation cloth may be replaced by a layer of felt, synthetic rubber foam or the like.

Figure 1:
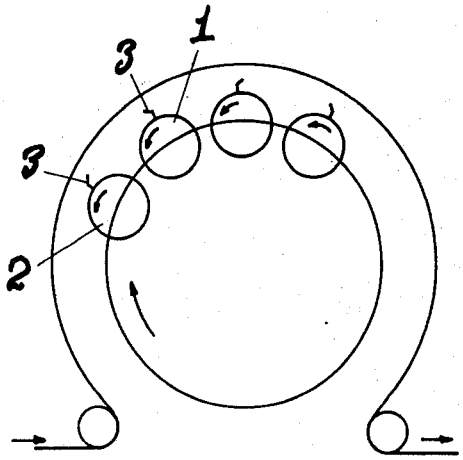
Fig. 1 PRIOR ART
FIG. 1 is a rough sketch showing the construction of a conventional raising machine.
Figure 3:
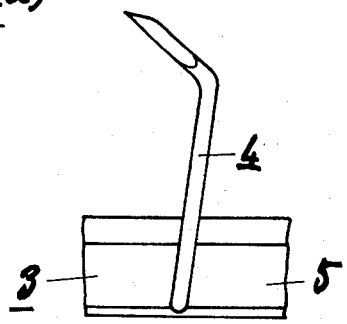
Fig. 3 (a) PRIOR ART
Figure 3:
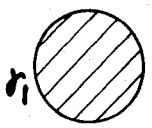
Fig. 3 (b) PRIOR ART
Figure 2:
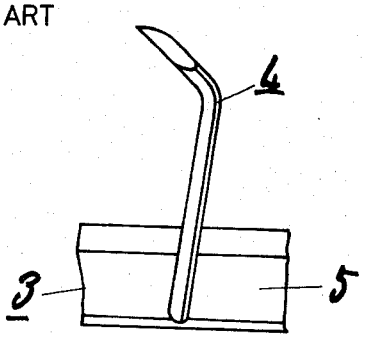
Fig. 2 (a) PRIOR ART
FIG. 2(*a*) and FIG. 3(*a*) are respectively front views of the main part of an individual wire of conventional raising machine wire clothing.
Figure 2:
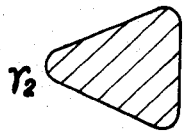
Fig. 2 (b) PRIOR ART
Figure 4:
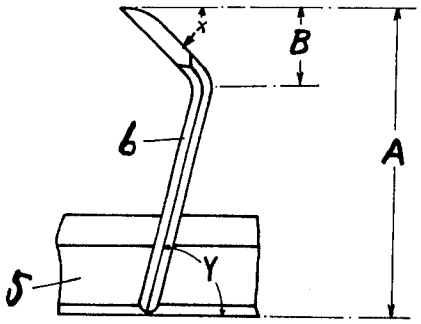
FIG. 4(*a*) is a front view of the main part of a wire for the raising machine wire clothing according to the present invention.
Figure 4:
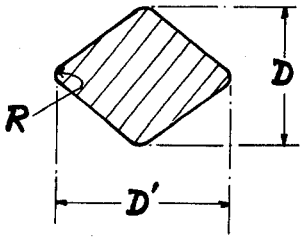
Figure 5:
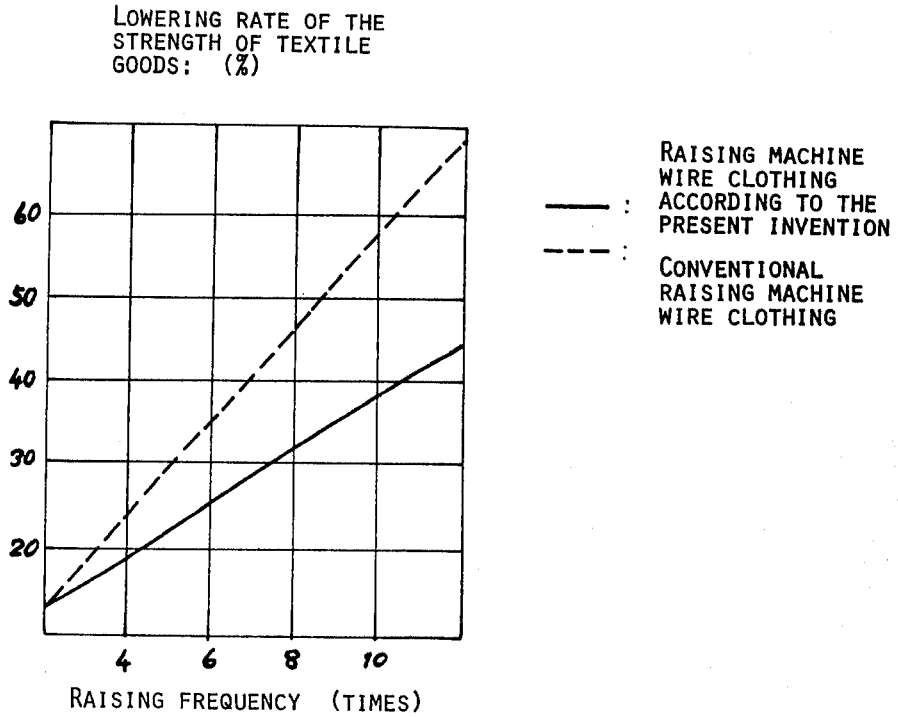
FIG. 5 is a curve showing the relationship between the rate of reduction of strength and the frequency of raising in the case of treating textile goods.
Figure 6:
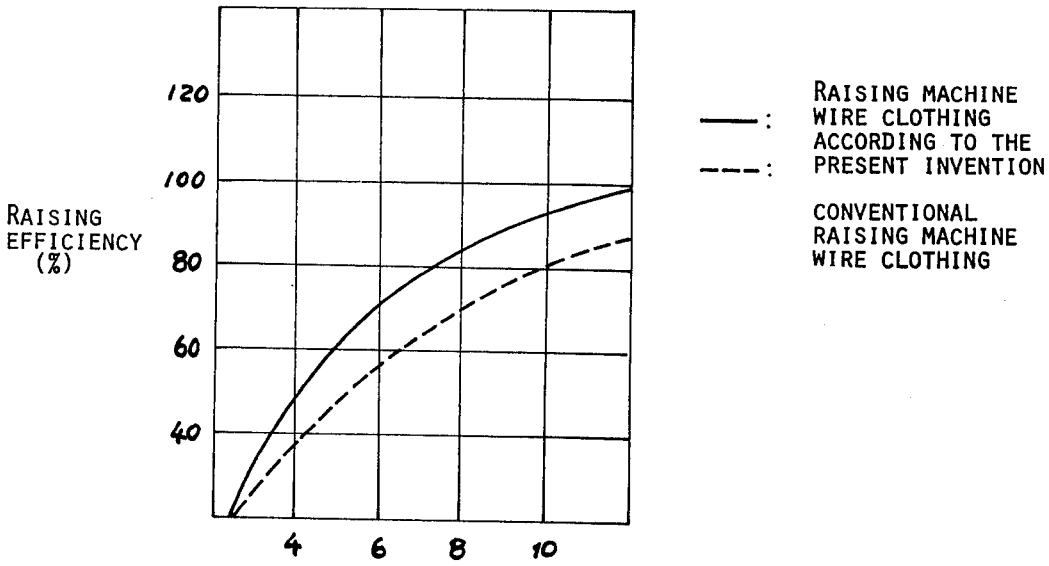
FIG. 6 is a curve showing the relationship between the raising efficiency and the raising frequency.
Figure 7:
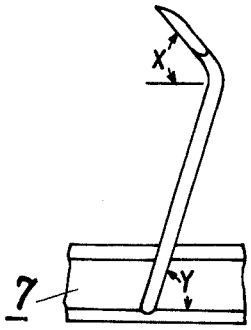
FIG. 7(*a*) and FIG. 8(*a*) are respectively a front view of the main part of a wire for the raising machine wire clothing to be used for the raising machine according to the present invention.
Figure 7:
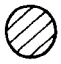
Figure 8:
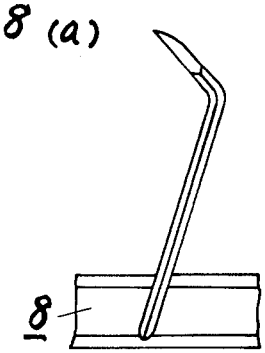
Figure 8:
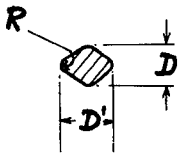

FIG. 5 and FIG. 6 show respectively the results of comparative tests of raising machine wire clothing according to the present invention used on counter pile rollers and pile rollers and the conventional raising machine wire clothing. From these test results, it can be seen that the raising machine wire clothing according to the present invention produces an excellent raising effect and raising efficiency, without appreciable lowering of the strength of the cloth.

Another embodiment of raising machine wire clothing 7 for the counter pile rollers 1 according to the present invention is shown in FIGS. *7a* and *7b*.

| Raising machine wire clothing for the counter pile roller | |
|---|---|
| Height of wire clothing (A): | 9–11 mm |
| Angle of working (X): | 45–65° |
| Angle of setting (Y): | 75–85° |
| Cross sectional shape of wire: | Circular |
| Diameter of wire (D): | 0.255–0.330 mm |
| Number of wire points: | 150–500 points/ square inch |

Wires used for raising machine wire clothing for counter pile rollers can be a type having a cross section which is either elliptical or sector shaped, namely, a type in which the circular arc at the point in working direction is large.

With the above arrangement, piles are drawn out of cloth to be raised by turning the raising machine wire clothing wound around the counter pile rollers 1, are further drawn out by pile rollers 2 and are cut by the sharp edge at the side of a working angle of wire into cut piles. Before and after the raising process, wire points and the sides of each wire point are ground for regulating the drawing out of piles and the cutting action.

Embodiment No. 2

Figure 9:
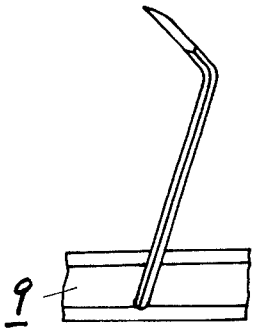
FIG. 9(*a*) and FIG. 10(*a*) are respectively a front view of the main part of a wire for the raising machine wire clothing according to another embodiment.
Figure 9:
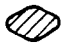
Figure 10:
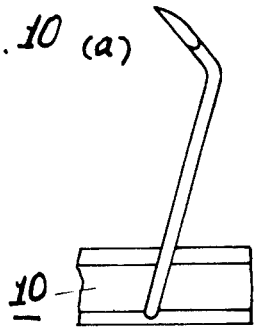
Figure 10:
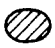

FIG. 9 and FIG. 10 show another embodiment of wires for raising machine wire clothing for counter pile rollers and raising machine wire clothing for pile rollers according to the present invention.

Raising machine wire clothing having wires, the cross section of which is substantially diamond (rhombic)-shaped as shown in FIG. 9 is wound round the counter pile rollers and raising machine wire clothing having wires, the cross section of which is elliptical (as shown in FIG. 10), circular or sectorial, is wound round the pile rollers. In using these raising machine wire clothings, the raising machine wire clothing mounted on the pile rollers draws out short piles due to the large circular arc at the forwardly facing part of the wire and the raising machine wire clothing having wires with a sharp edge at the forwardly facing part of the wire cuts piles quickly. Thus, raising machine wire clothing according to this embodiment is effective for producing short cut piles.

Since the raising machine wire clothing according to the present invention has the construction as described above, it is most suitable for raising a finish of short piles and high density of nap, namely, so-called suede tone finish. In addition, since it uses wires the cross section of which is substantially diamond (rhombic)-shaped, the wires have high strength and are usable for a longer period of time.

In the raising machine in which raising machine wire clothing having wires the cross section of which is substantially diamond (rhombic)-shaped is used at least either on counter pile rollers or pile rollers, piles drawn out are cut by the sharp edges of the wires the cross section of which is substantially diamond (rhombic)-shaped and thus cloth of high value with short piles and high density of nap or so-called suede tone can be obtained. Also, raising machine wire clothing according to the present invention has the advantages that the time of shearing during an after-process can be shortened and loss of weight by shearing can be reduced to a large extent.

What we claim is:

1. A raising machine for producing a suede tone finish of short pile and high nap desnity on cloth having a set of counter pile rollers and a set of pile rollers, and raising machine wire clothing on said counter pile rollers and having wires of substantially diamond-shape cross-section of four equal sides enclosing two obtuse and two acute angles and a radius of less than 0.1 mm at the acute angle corners of the cross-section of the wire, the acute angle corners of the cross-section of the wires facing in the direction of rotation of the rollers of said set of counter pile rollers, and the wires on said pile rollers having a circular cross-section, whereby, by the use of said sets of rollers, short piles drawn out by the clothing of the pile rollers are cut by the clothing of the counter pile rollers such that a suede tone finish of short pile and high density can be produced.

2. A raising machine for producing a suede tone finish of short pile and high nap density on cloth having a set of counter pile rollers and a set of pile roller, and raising machine wire clothing on said counter pile rollers and having wires of substantially diamond-shape cross-section of four equal sides enclosing two obtuse and two acute angles and a radius of less than 0.1 mm at the acute angle corners of the cross-section of the wire, the acute angle corners of the cross-section of the wires facing in the direction of rotation of the rollers of said set of counter pile rollers, and the wires on said pile rollers having an elliptical cross-section, whereby, by the use of said sets of rollers, short piles drawn out by the clothing of the pile rollers are cut by the clothing of the counter pile rollers such that a suede tone finish of short pile and high density can be produced.

3. A raising machine for producing a suede tone finish of short pile and high nap density on cloth having a set of counter pile rollers and a set of pile rollers, and raising machine wire clothing on said counter pile rollers and having wires of substantially diamond-shape cross-section of four equal sides enclosing two obtuse and two acute angles and a radius of less than 0.1 mm at the acute angle corners of the cross-section of the wire, the acute angle corners of the cross-section of the wires facing in the direction of rotation of the rollers of said set of counter pile rollers, and the wires on said pile rollers having a sector-shaped cross-section, whereby by the use of said sets of rollers, short piles drawn out by the clothing of the pile rollers are cut by the clothing of the counter pile rollers such that a suede tone finish of short pile and high density can be produced.

* * * * *